United States Patent [19]

Nimetz

[11] 4,091,489

[45] May 30, 1978

[54] BRUSH POINTER

[76] Inventor: Jack Nimetz, 1605 Timberline Rd., Silver Spring, Md. 20904

[21] Appl. No.: 696,473

[22] Filed: Jun. 15, 1976

[51] Int. Cl.[2] ..... A46B 17/06; B05C 11/105

[52] U.S. Cl. ..... 15/104.92; 118/268

[58] Field of Search ..... 15/104.92, 257.05; 118/264, 268, 270; 131/236; 401/121, 122

[56] References Cited

U.S. PATENT DOCUMENTS

| | | | |
|---|---|---|---|
| 204,625 | 6/1878 | Silsbee | 15/257.05 |
| 2,029,672 | 2/1936 | Rankin | 15/210 B |
| 2,120,110 | 6/1938 | Morrell | 118/268 |
| 2,975,464 | 3/1961 | Schultz | 401/198 X |
| 3,000,040 | 9/1961 | Carlson | 401/198 |
| 3,004,515 | 10/1961 | Hummel | 118/270 |
| 3,894,650 | 7/1975 | Crump | 220/90 |

FOREIGN PATENT DOCUMENTS

| | | | |
|---|---|---|---|
| 230,295 | 1/1911 | Germany | 401/122 |
| 375,276 | 3/1923 | Germany | 15/257.05 |
| 1,093,272 | 11/1960 | Germany | 401/122 |
| 164,227 | 12/1933 | Switzerland | 118/268 |

*Primary Examiner*—Daniel Blum
*Attorney, Agent, or Firm*—Lowe, King, Price & Markva

[57] ABSTRACT

A device for cleaning the bristles of a brush and for pointing the bristles includes a reservoir for a cleaning liquid for the bristles. A top for the reservoir includes a guide aperture through which the brush can be inserted to enable the bristles to be inserted into the liquid in the reservoir. A point forming aperture for the bristles communicates with the guide aperture. The point forming aperture includes a pair of resilient, normally contacting lips that are formed as a slit in a sponge. The lips are urged apart as the brush is withdrawn from the reservoir and surround and contact the bristles to control the shape of the bristles. The sponge includes a foot that is inserted into the liquid to draw the liquid by capillary action to the lips so that they are maintained moist. To form a fine tip on the brush, the brush is rotated about its longitudinal axis while the bristles are drawn through the lips. To provide a chisel tip, the brush is drawn through the lips without turning it about its longitudinal axis.

6 Claims, 4 Drawing Figures

BRUSH POINTER

This invention relates to a device for forming and cleaning artist's brush tips. Particularly, the present invention provides a new and novel device for cleaning, wetting and forming a tip on soft hair fiber brushes such as red sable, camel and similar fiber artist's and illustrator's brushes.

Artists, illustrators and ceramists who utilize soft-hair brushes require them to be properly wetted and precisely tipped, because of the precision nature of their work. For example, a ceramist specializing in prosthadontic porcelain restoration, uses a small camel hair or sable hair brush for the application of the wetted porcelain material to the metallic casing of the crown or bridgework. Small amounts of porcelain are lifted by inserting a tip of the brush in the wetted porcelain pile, i.e., slurry; the success with which the porcelain is removed from the slurry depends on the accuracy of the tip which is formed on the brush. A damp, very pointed brush tip, can penetrate the porcelain pile, and the exact amount required can be removed. If the brush tip is blunt, the porcelain is pushed aside and very little attaches to the brush tip. Usually, the brush is dipped into a container of water and the brush tip is rubbed on water absorptive tissue or sponge to remove excess water and form the tip. Sometimes, the user may put the brush in the mouth to form a tip. This method creates an obvious health hazard to the person due to ingestion of porcelain material. Similarly, artists and illustrators require a properly formed brush tip for producing fine details. Again, various methods are used to clean, remove excess water or cleaning solution, and form the tip on brush. Cleaning is done by inserting into solution and moving brush vigorously to remove residue. This usually causes excess water or sometimes causes solution to be spilled or splashed onto a working surface. The brush tip is usually formed by rubbing the brush tip over absorptive material to remove moisture and to form point, using fingers to form fibers, or placing brush into the mouth. There is an obvious health hazard from swallowing paint or ink over an extended period of time, no matter how much it is diluted.

The objects of the present invention are to provide the following:

First, to provide a brush pointer and cleaner which is simple and efficient in operation.

Second, to provide a method for forming a properly cleaned, wetted, and shaped brush tip for soft-hair brushes, such as red sable, camel, and similarly made brushes.

Third, to provide an inexpensive and commercially feasible brush point former and cleaner.

The foregoing and other objects, the advantages and novel features of this invention, may be more fully understood from the following description, when read in conjunction with the accompanying drawings in which like reference numerals refer to like parts, and in which.

Figure 1:
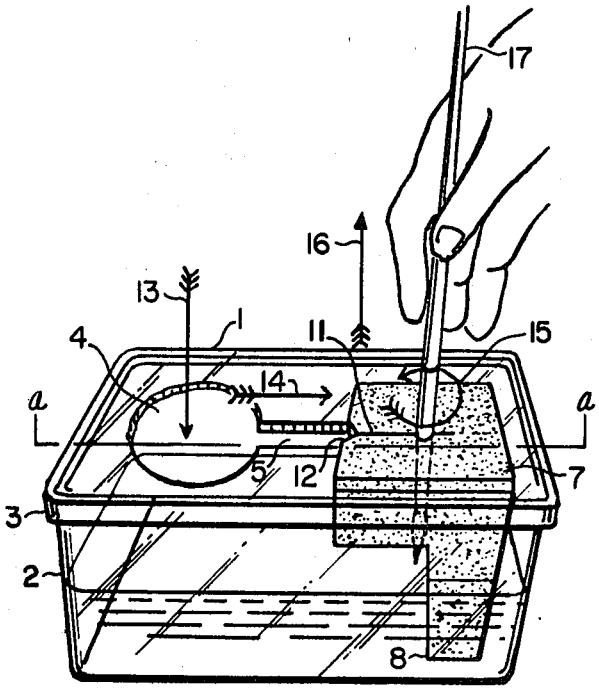
FIG. 1 is a perspective view of my invention.
Figure 2:
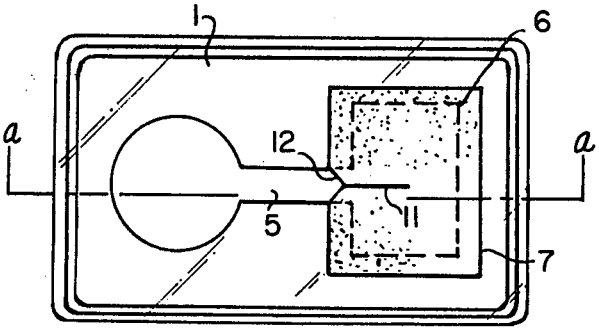
FIG. 2 is a plan view of the perspective view.
Figure 3:
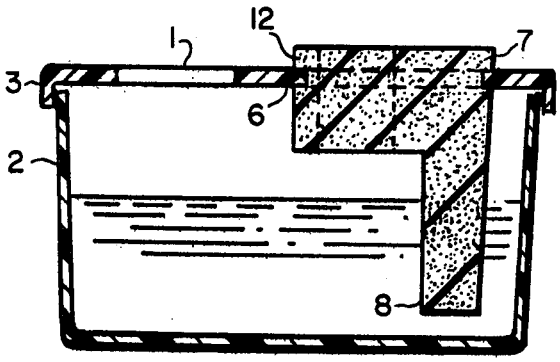
FIG. 3 is a vertical sectional view taken along line a-a of FIG. 2.
Figure 4:
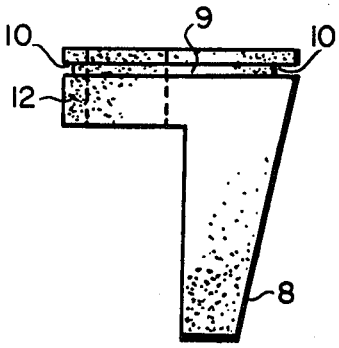
FIG. 4 is a side elevational view of the insert unit.

Referring more in detail to the drawings, as illustrated in FIG. 1, a cover top 1 and container 2, preferably made of clear or translucent plastic material, constitute an overall case for the brush tip former. A flange 3 as part of the top cover 1, fits snugly to the edge of the side of the container 2. The top cover 1 is perforated with an aperture 4 whose outer edge is open to a slot 5 whose width is somewhat larger than the brush shaft used. The slot 5 terminates to another aperture 6 shown in the plan view FIG. 2. The geometric shapes of apertures 4 and 6 are respectively shown as a circle and a rectangle, but any particular design can be used, providing the relationships of the apertures to the slot as described are still maintained. An insert unit 7 made of liquid absorbing sponge material fits into the aperture 6. With reference to FIG. 2, the top plan dimension of the insert unit 7 is larger than aperture 6 and is similar in its geometric shape. With reference to FIG. 3, insert unit 7 has a thickness in the axial direction of terminating aperture 6 equal to approximately the length of the brush tip. An extension foot 8 projects into the bottom of the container 2 as clearly shown in FIG. 3. With reference to FIG. 4, the insert unit includes a slit 9 cut entirely around the sides of the insert unit. Slit 9 located at a midway point down the sides of the insert unit 7, but does not extend to the foot 8. The slit 9 forms an undercut 10 in the sponge block portion of the insert unit 7 whose inside dimensional perimeter is larger than the perimeter of aperture 6. Upon insertion of the insert unit 7 into the aperture 6, a slight compression of the sponge block occurs because of the size relation between the terminating aperature 6 and the slit 9 undercut dimension 10. With reference to FIG. 2, a slit 11 is cut completely through the upper block of insert unit 7 to a mid point in front of the extension foot 8, and is positioned to the centerline of the guide slot 5. Slit 11 is a point forming aerture for the brush and receives the brush from a guide aperture formed by aperture 4 and guide slot 5. Slit 11 forms a pair of resilient normally contacting lips that are urged apart in a region in contact with the brush, but which surround and contact the brush and bristles to control the shape of the bristles are drawn through the slit. The slit 11 is beveled at the guide slot 5 such that the distance between the widest part of the bevel equals the width of the guide slot 5.

The present invention is used in the following manner:

The container 2 is filled with a cleaning solution for the particular medium used, such as water for use with soluble inks and paints or porcelain material. The insert unit 7 is wetted and the excess moisture is squeezed out. The amount of moisture remaining in the container determines the wetness of insert unit 7, and, therefore, also that of the brush tip. Unit 7 is inserted in the aperture 6 insuring that the slit 9 (REF. FIG. 4) interlocks with the edges of the terminating aperture 6. The extension foot 8 is immersed in the solution, and by capillary action, draws water up into the sponge material. This prevents the insert unit 7 from drying out due to evaporation. The device is ready for use. With reference to FIG. 1, the direction indicator arrows 13, 14, 15, and 16, show the brush movements in my invention. The brush is inserted in the aperture 4 as shown by arrow 13; sufficient movement of the brush in the solution cleans the brush. The top cover 1 prevents splashing or spillage on the working surface. The brush 17 is moved into the guide slot 5 indicated by arrow 14. This motion is performed without the user having to look at what he is doing since the slot 5 intersects into the aperture 4 and, therefor, automatically acts as a guide. The brush is moved toward the slit 11 in the insert unit 7. The beveled edge 12 of the slit 11 allows the brush handle to move into slit 11 easily without interference or binding. The compression of the sponge material keeps the brush tip completely and firmly enclosed in the slit 11. The brush is lifted out of the insert unit with either a straight out motion or a twisting motion. In the case of the former, indicated by direction arrow 16, the brush tip is formed in a flat chisel-like edge, or the twisting motion forms a pointed tip. In either case, the hairs of the brush, as they move through the slit 11, are squeezed slightly, removing excess moisture and forcing the brush hairs to compress. The slight rotating motion of the brush being removed causes the hairs of the brush to rotate around the "axis" of the brush handle, wrapping themselves to a fine point.

As is apparent from the foregoing description, my invention provides a novel device for simply, quickly, and conveniently cleaning and forming a point on soft-haired brushes. While I have referred to the present invention particularly for use by artists and ceramists who require precise forming and cleaning of small brushes, it may be readily used for other purposes, and the size and shape of the container can easily be modified for different size brushes without changing the principles of its operation.

I claim:

1. A device for cleaning bristles of a brush and for pointing the bristles comprising means forming a reservoir for a liquid adapted to clean the bristles, a top for said reservoir, said top including: (a) a guide aperture through which the brush bristles can be inserted to enable the bristles to be inserted into the liquid, and (b) a point forming aperture communicating with the guide aperture to receive the brush from the guide aperture, said point forming aperture having a pair of resilient normally contacting lips that are urged apart in a region in contact with the brush but which surround and contact the moist bristles to control the shape of the bristles as the bristles are drawn through the forming aperture from the reservoir, further including drawing means for moistening the lips with liquid from the reservoir, wherein the drawing means includes capillary means extending from the reservoir to the lips.

2. The device of claim 1 wherein the lips are formed by a sponge like material extending into said liquid reservoir, said capillary means including a foot of said sponge like material adapted to draw liquid from said reservoir to maintain the lips moist.

3. The device of claim 2 wherein the sponge like material includes a slit forming the lips and a pair of edges tapering outwardly from the slit to the guide aperture.

4. The device of claim 3 wherein the top forms a removable cover for said reservoir means.

5. The device of claim 4 wherein the cover includes a further aperture for receiving a mass of the sponge like material, said mass having an area in excess of said further aperture and a slot for receiving the cover so that the mass is captured in said further aperture.

6. The device of claim 1 wherein the lips are formed by a sponge like material.

* * * * *